United States Patent [19]

Gronau et al.

[11] Patent Number: 4,856,250

[45] Date of Patent: Aug. 15, 1989

[54] SLEEPER FOR THE ATTACHMENT OF COVERING MATERIAL TO A SURFACE

[76] Inventors: Arthur W. Gronau; Gregory S. Gronau, both of 875 N. Lively Blvd., Wood Dale, Ill. 60191

[21] Appl. No.: 40,172

[22] Filed: Apr. 17, 1987

[51] Int. Cl.[4] ..... E06B 3/54

[52] U.S. Cl. ..... 52/480; 52/376

[58] Field of Search ..... 52/368, 374, 376, 480, 52/401, 402, 403, 710

[56] References Cited

U.S. PATENT DOCUMENTS

| | | | |
|---|---|---|---|
| 802,622 | 10/1905 | Van Den Bulcke . | |
| 1,195,289 | 8/1916 | Stevens . | |
| 1,302,578 | 5/1919 | Murphy | 52/480 X |
| 1,339,425 | 5/1920 | Stevens . | |
| 1,343,234 | 6/1920 | Stevens . | |
| 1,491,198 | 4/1924 | Cassidy . | |
| 1,668,842 | 5/1928 | Dudfield et al. . | |
| 1,692,855 | 11/1928 | Murphy . | |
| 1,693,655 | 12/1928 | Murphy | 52/480 X |
| 1,752,583 | 4/1930 | Wright . | |
| 1,781,117 | 11/1930 | Mackie et al. . | |
| 1,911,433 | 5/1933 | Cinnamond . | |
| 1,977,496 | 10/1934 | Snyder et al. . | |
| 2,167,836 | 8/1939 | Greulich | 52/376 |
| 2,708,781 | 5/1955 | McMullan . | |
| 2,996,160 | 8/1961 | Voight . | |
| 3,045,294 | 7/1962 | Livezey, Jr. . | |
| 3,271,916 | 9/1966 | Omholt . | |
| 3,562,990 | 2/1971 | Boettcher . | |
| 3,596,422 | 8/1971 | Boettcher . | |
| 3,786,608 | 1/1974 | Boettcher | 52/480 |

FOREIGN PATENT DOCUMENTS 53863 6/1980 Denmark .

OTHER PUBLICATIONS

Stevens System of Sound and Vibration Control.
Wood & Synthetic Flooring, developed by Wood & Synthetic Flooring Institute, Jan. 1, 1978.
Hard Maple & Rubber Sports Surfaces by Robbins, Inc. 1985.

*Primary Examiner*—David A. Scherbel
*Assistant Examiner*—Creighton Smith
*Attorney, Agent, or Firm*—Willian Brinks Olds Hofer Gilson & Lione Ltd.

[57] ABSTRACT

A sleeper is disclosed comprising a guideway, a resilient strip, a nailing bed and a spring. The guideway is an elongated channel of C-shaped cross-section with three fully closed faces and a partially open face. A plurality of the guideways are fastened to the floor base and the resilient strips placed in the bottom of the guideways. The nailing bed is an elongated wooden element with an elongated protrusion. The nailing bed defines an inverted T-shaped cross-section and is placed in each guideway above the resilient strip. The protrusion of the nailing bed extends through the partially open face for attachment to the flooring material. The nailing bed is shorter than the guideway to leave sufficient room within the guideway at at least one end of the guideway for the spring. The spring is inserted with one end against the end of the nailing bed. The spring is then compressed and a stop inserted through the guideway to maintain the spring in the compressed condition. The spring acts to bias the nailing bed and the attached flooring material in a direction defined by the guideway.

20 Claims, 2 Drawing Sheets

FIG. 1
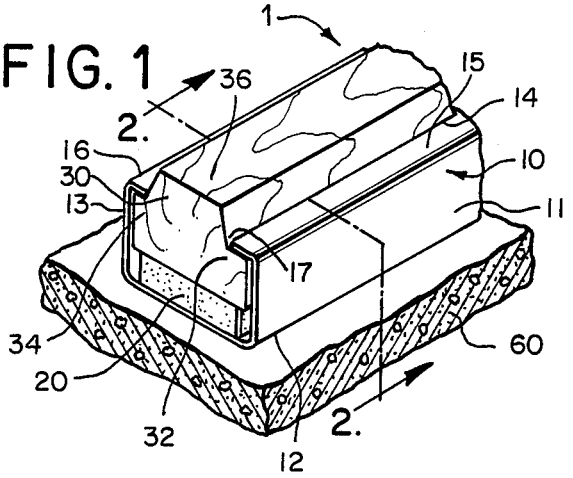
FIG. 2
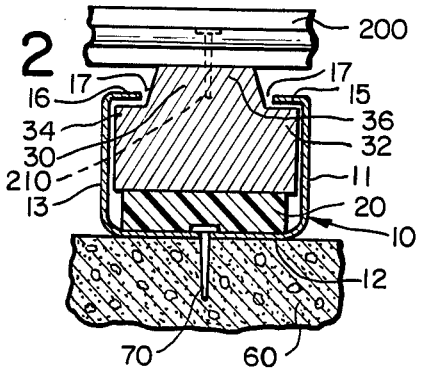
FIG. 3b
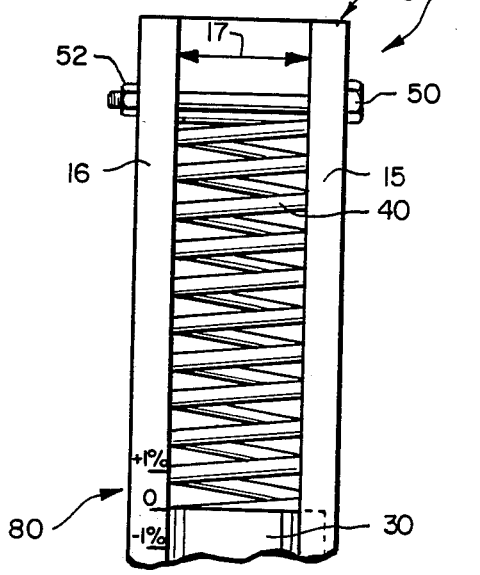
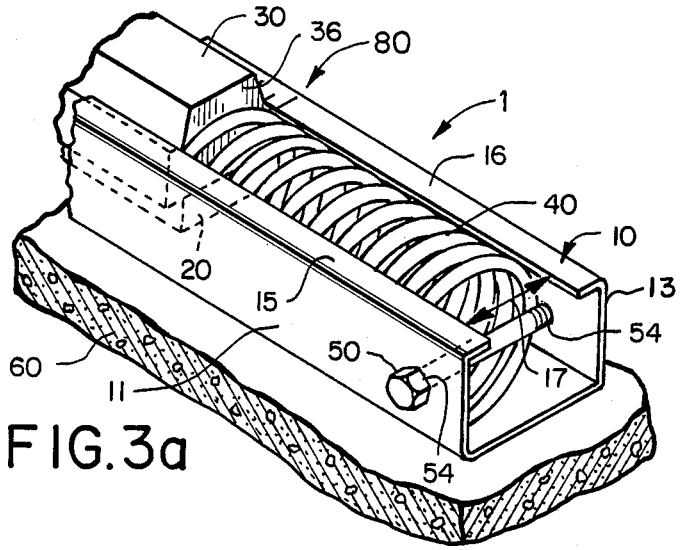
FIG.3a
FIG. 4
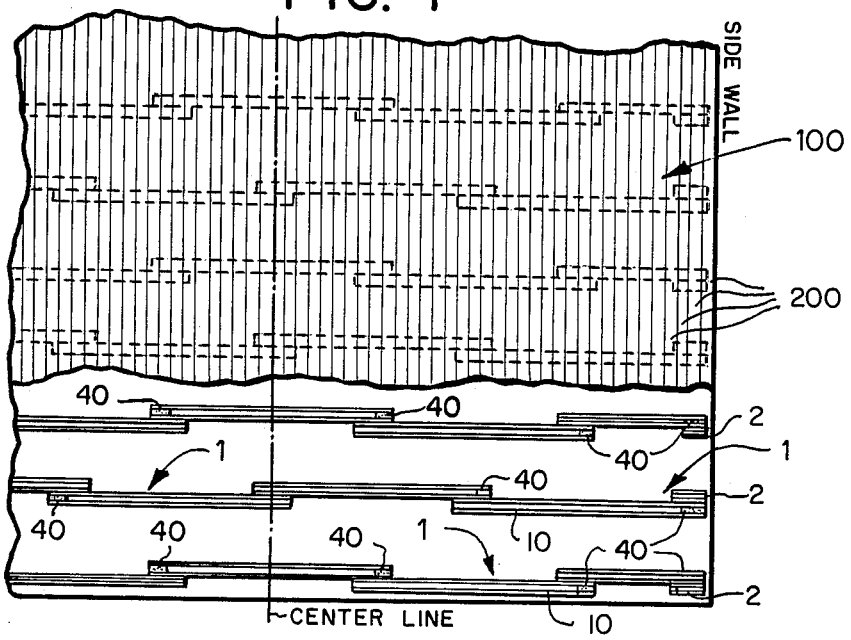

SLEEPER FOR THE ATTACHMENT OF COVERING MATERIAL TO A SURFACE

BACKGROUND OF THE INVENTION

The present invention relates to an improved sleeper comprising a nailing bed and a containment guide for attaching covering material to a surface.

Sleeper systems are frequently used to support or anchor a floor to a floor base. Typically, the floor base is a concrete slab and the flooring material comprises hardwood tongued and grooved boards or other porous covering material. In the case of wooden flooring material, the dimensions of the wood changes as the moisture content of the wood changes. This dimensional instability can result in undesirable buckling or cracking of the floor covering.

To limit the transfer of moisture from the floor base to the floor boards, many sleeper systems elevate the floor boards above the floor base. The elevation enables air to circulate between the concrete and the wood floor and also eliminates direct capillary transference of moisture. Other techniques include plastic sheeting to act as a vapor barrier, water proof coatings on the floor base and water proof coatings on the flooring material. In addition to limiting the transfer of moisture, sleeper systems have been designed to accommodate the change in moisture content. When wooden floor boards absorb moisture, they expand; when the boards dry out, they contract. Some sleeper systems allow the flooring material to slide relative to the floor base in response to dimensional changes of the flooring. The sleepers are adapted to slide across the floor base during the expansion and compression of the floor boards to relieve pressure on the boards and prevent buckling of the floor.

In addition to moisture control, it is also often desirable to provide the floor with some degree of resiliency. This is especially desirable with flooring installations used in areas of high physical activity such as gymnasiums, squash courts, dance studios, and the like. A resilient floor not only provides a better playing surface, but also acts as a shock absorber to reduce player injuries. This resiliency is often provided by supporting the nailing beds above the floor base with springs or foam cushions.

SUMMARY OF THE INVENTION

The present invention is directed to an improved sleeper for the attachment of covering material to a surface wherein the sleeper comprises a guideway for attachment to a surface and a nailing bed adapted for attachment to the covering material and operative to slide within the guideway.

According to a preferred embodiment of the present invention, a sleeper is provided comprising an elongated metal guideway of C-shaped cross-section, a strip of resilient material, and at least one nailing bed. The guideway is used to contain and guide a plurality of nailing beds along a predetermined direction. The guideway may be leveled and fastened to a floor base by conventional means. The strip of resilient material is positioned to support the nailing bed within the metal guideway and to bias the nailing bed away from the floor base. The metal guideway defines the vertical and horizontal space within which the nailing bed can move.

According to a second preferred embodiment, a sleeper is provided comprising a metal guideway, at least one nailing bed and a coil spring. The guideway is of C-shaped cross-section and is used to guide the nailing bed. The guideway may be leveled and fastened to the concrete base by conventional means. As in the first embodiment, the nailing bed is positioned within the guideway and cooperates with the guideway such that the nailing bed is confined to a predefined vertical space within the guideway. After the floor boards are attached to the nailing bed, a biasing spring is inserted into the guideway at one end. The spring is compressed and a spring stop attached to the guideway to allow the spring to bias the nailing bed and the attached floor boards. The sleepers are oriented such that all the floor boards are biased to the center of the room. The second preferred embodiment may be used with or without a strip of resilient material between the guideway and the nailing bed to provide a measure of resiliency.

According to a third preferred embodiment, a sleeper is provided similar in structure and function to that of the second preferred embodiment. The third embodiment however biases the nailing bed within the guideway by means of two coil springs positioned along the outer sides of the guideway. Since the springs are positioned outside the guideway, the nailing bed may extend the full length of the guideway. This allows the sleeper to better support the flooring material, especially near the side walls of a room.

It is an object of a preferred embodiment of the present invention to provide a sleeper that not only accommodates the expansion and de-expansion of the flooring material, but also biases the flooring material to a desired configuration.

It is also an object of a preferred embodiment to provide an economical and easily installable sleeper wherein the nailing bed and means for providing resiliency are contained in a guideway to allow the nailing bed to move in response to dimensional changes in the flooring material.

It is a further object of a preferred embodiment to provide a sleeper which biases the flooring material and may be used to support the flooring material in close proximity to the side walls of a room.

The invention itself, together with further objects and attendant advantages, will best be understood by reference to the following detailed description, taken in conjunction with the accompanying drawings.

BRIEF DESCRIPTION OF THE DRAWINGS

FIG. 1 is a perspective view of a portion of the first preferred embodiment.

FIG. 2 is a cross-sectional view of the embodiment of FIG. 1 taken along line 2—2.

FIG. 3*a* is a plan view of a portion of the second preferred embodiment showing the coil spring.

FIG. 3*b* is a perspective view of a portion of the embodiment of FIG. 3*a*.

FIG. 4 is a schematic view of a preferred layout of a plurality of second embodiments for installation of a hardwood tongued and grooved floor.

DETAILED DESCRIPTION OF THE PRESENTLY PREFERRED EMBODIMENTS

Figure 5A:
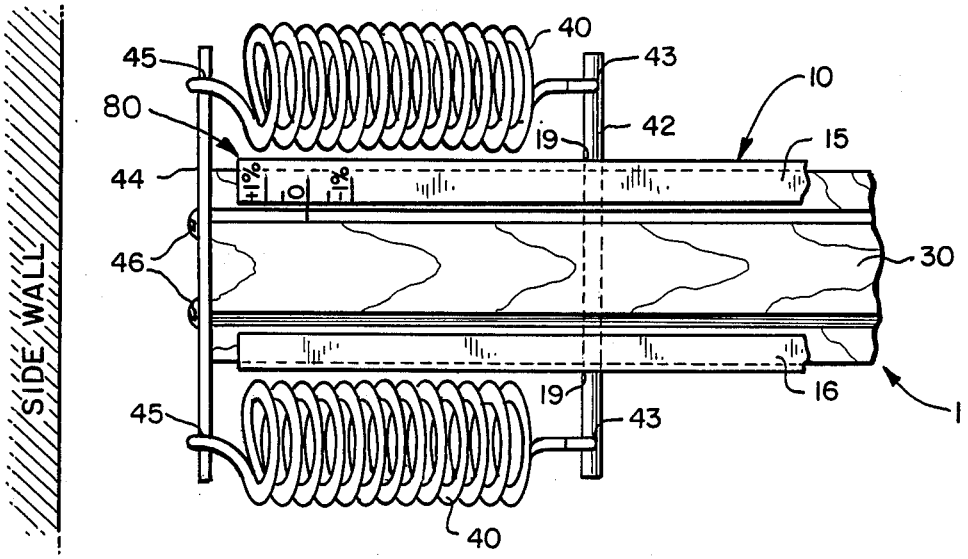
FIG. 5*a* is a plan view of a portion of a third embodiment similar in structure to the embodiment of FIG. 3*a* but with two coil springs positioned along the outer sides of the guideway.

Turning now to the drawings, FIG. 1 shows a perspective view of a first preferred embodiment of a sleeper, generally represented as reference numeral 1. FIG. 2 is a cross-sectional view taken along line 2—2 of FIG. 1. The sleeper 1 comprises an elongated metal guideway 10 of C-shaped cross-section. The guideway 10 defines three elongated fully closed faces 11, 12, 13 and a partially open top face 14. The guideway 10 is shown in FIG. 1 with the face 12 resting on the floor base 60. The partially open face 14 comprises two elongated tabs 15, 16 separated from each other to define an elongated slot 17.

A resilient foam strip 20 is positioned inside the guideway 10 along the bottom and extends substantially the length of the guideway 10. A nailing bed 30 is positioned within the guideway 10 above the resilient strip 20. The nailing bed 30 is wooden and defines a substantially inverted T-shaped cross-section. The nailing bed 30 comprises two shoulders 32, 34 and a beveled protrusion 36. The nailing bed 30 is positioned within the guideway 10 above the resilient strip 20. A plurality of resilient foam strips 20 and nailing beds 30 may be used adjacent one another to extend substantially the length of the guideway 10.

The nailing bed 30 is cross-sectionally dimensioned such that when combined with the resilient strip 20, the nailing bed 30 and strip 20 are not tightly engaged by the guideway 10. The shoulders 32, 34 of the nailing bed 30 are dimensioned to confine the nailing bed 30 to a predefined vertical space within the guideway 10 by engagement with the tabs 15, 16 of the guideway 10. The protrusion 36 extends between the tabs 15, 16 through the slot 17 such that the end of the protrusion 36 is above the guideway 10.

During installation, a plurality of guideways 10 are placed at desired locations along the floor in a conventional manner. The ends of the sleepers 1 are positioned close to but not in contact with the side walls of a room as in conventional sleeper systems. Typically, the floor boards 200 are tongued and grooved hardwood strips. Each floor board 200 defines a longitudinal axis, and, generally, the grain of each floor board 200 runs parallel to the longitudinal axis. Each guideway 10 also defines a longitudinal axis and is oriented such that its longitudinal axis is aligned substantially perpendicularly to the desired direction of the longitudinal axis of the flooring strips 200.

Each guideway 10 is leveled in a conventional manner using conventional means such as shims and the like (not shown) and is fastened to the floor base 60 in a conventional manner such as by a hardened fastening element 70, shown in FIG. 2. Once leveled and fastened to the floor base 60, the resilient strip 20 may be inserted into the guideway 10. If desired, multiple strips 20 may be used in the vertical and horizontal directions to form the desired thickness and length. A nailing bed 30 is then slid into the guideway 10 above the resilient strip 20. If desired multiple nailing beds 30 may be used to form the desired length. In the preferred embodiment, three nailing beds 30 are used along with sufficient lengths of resilient strips 20 to extend the combined length of the nailing beds 30.

Once a sufficient number of sleepers 1 have been assembled, the floor boards 200 may be applied to the nailing beds 30. The floor boards 200 are applied in a conventional manner and may be preceded by a subfloor (not shown) if desired. The nailing beds 30 are formed of wooden material and are adapted to receive fastening elements 210 such as nails and the like driven through the floor boards 200 into the protrusion 36.

In operation, the nailing beds 30 are supported by the resilient strips 20 to provide resiliency to the floor. A force applied to the floor boards 200 is transmitted through the nailing beds 30 to the resilient strips 20. Under a force of sufficient magnitude, the resilient strips 20 compress and the nailing beds 30 and floor boards 200 move downwardly. The protrusion 36 prevents the floor boards 200 from engaging the guideway 10. The beveling of the protrusion 36 prevents the protrusion 36 from significantly engaging the tabs 15, 16. Upon removal of the force, the resilient strips 20 de-compress, pushing the nailing beds 30 and the attached floor boards 200 upwardly to their original position.

Expansion and contraction of the floor boards 200 are accommodated by the sleepers 1. The greatest dimensional instability of the floor boards 200 is in the direction transverse to the grain of the floor board 200. As indicated above, the sleepers 1 are positioned with their longitudinal axes oriented substantially perpendicularly to the grain of the floor boards 200. Since the nailing beds 30 are not fixedly fastened to the guideways 10, the nailing beds 30 can move slidably along the longitudinal axis defined by the guideway 10. The ability of the nailing beds 30 to slide within the guideway 10 helps to remove undesirable pressure on the floor boards 200 in response to changes in their moisture content. Although the pressure may not be relieved from each floor board 200, the pressure will be significantly relieved from larger sections of the floor. This pressure reduction is sufficient to reduce buckling and cracking of the floor. Further, since the nailing beds 30 of the sleepers 1 are prevented from escaping the confines of the guideway 10 by engagement of the tabs 15, 16 with the shoulders 32, 34 of the nailing beds 30, the vertical integrity of the floor is maintained.

A second preferred embodiment of a sleeper is shown in FIGS. *3a, 3b* and generally represented with reference numeral 1. In describing the second embodiment, structure similar in shape and function to that of the first preferred embodiment will be designated by like reference numerals.

The sleeper 1 of the second embodiment comprises an elongated guideway 10 of C-shaped cross-section and a nailing bed 30 as described in reference to the first embodiment. A resilient strip 20 is positioned between the nailing bed 30 and the bottom of the guideway 10 as in the first embodiment. It should be understood that the resilient strip 20 may be removed if desired. Of course, if the strip 20 is removed, the nailing bed 30 or the guideway 10 should be dimensioned to limit the vertical movement of the nailing bed 30 within the guideway 10 and to ensure that the protrusion 36 of the nailing bed 30 extends sufficiently above the guideway 10 to prevent the floor boards 200 from substantially engaging the guideway 10.

The sleeper 1 further comprises a coil spring 40, a stop 50 and a fastening element 52 positioned at one or both ends of the guideway 10. For purposes of illustration, FIGS. *3a, 3b* show only one end of the sleeper 1 with a spring 40, stop 50 and fastening element 52. The stop 50 extends through apertures 54 located in the sides 11, 13 of the guideway 10. The coil spring 40 is positioned between one end of the nailing bed 30 and the stop 50. The coil spring 40 is compressed to exert a force on the nailing bed 30 along the direction defined by the guideway 10. A scale 80 located on the tab 16 of the guideway 10 indicates the amount of compression undergone by the spring 40.

The installation of the second embodiment is schematically shown in FIG. 4. The room 100 in which the floor is to be installed defines a center line and for purposes of illustration is rectangular in shape. Each floor board 200 defines a longitudinal axis and the grain of the wood of each floor board 200 runs substantially parallel to the longitudinal axis of the floor board 200. The guideways 10 are placed such that their longitudinal axes are oriented substantially perpendicularly to the center line. The guideways 10 are positioned to form a series of lineal configurations. Each lineal configuration is comprised of a plurality of guideways 10. Within each lineal configuration, each guideway 10 overlaps the adjacent guideway 10. The region of overlap of the guideways 10 is arranged to not be directly opposite the region of overlap of the guideways 10 in the adjacent lineal configuration, as shown in FIG. 4. Thus, every other lineal configuration will have one guideway 10 straddling the center line. The overlap is desirable since each sleeper 1 has a region of the guideway containing the spring 40 at which the floor boards 200 are not supported.

Each guideway 10 is leveled and fastened to the floor base by conventional means. The resilient strips 20 are then placed in the inside bottom of the guideway 10. Three nailing beds 30 are positioned within the guideway 10 above the resilient strip 20. The positioning of the nailing beds 30 determines the distance between the stop 50 and the end of the nailing bed 30. The nailing beds 30 may be positioned along the guideways 10 in dependence upon the moisture content of the floor boards 200, the floor board material, distance from the center of the room, the desired biasing force, and the like. The variable positioning determines the amount of compression to be imposed on the spring 40 and therefore the amount of biasing to be applied to the nailing beds 30 and the attached floor boards 200. The scale 80 may be used to indicate the degree of biasing during installation.

In the preferred embodiment, the biasing of the spring 40 is set in dependence upon the moisture content of the wood flooring material relative to the median moisture content of wood flooring material for the climate in which the floor is being installed. A $\frac{1}{4}$ inch compression is used for each percent of moisture content over or under the median for that climate. Generally, some degree of compression is desirable. Thus, if the moisture content of the boards 200 is $-1\%$ of the median the spring 40 is compressed $\frac{1}{4}$ inches; if the moisture content is 0% of the median a $\frac{1}{2}$ inch compression is used; if the moisture content is 1% of the median a $\frac{3}{4}$ inch compression is used; and so on.

The floor boards 200 are attached to the nailing beds 30 from the center line outwardly by conventional means. Each spring 40 is placed into the guideways 10 when the attachment of the floor boards 200 reaches the end of the nailing bed 30 located at the end of the guideway 10. In the case of the guideways 10 which straddle the center line, a spring 40, stop 50 and fastening element 52 is used at both ends. The spring 40 is sufficiently compressed to allow placement of the stop 50 and fastener 52. Once the stop 50 and fastener 52 are positioned, floor boards 200 may be placed over the spring 40 by fastening the floor boards 200 to the overlapping end of the nailing bed 30 of the adjacent sleeper 1 in the same lineal configuration.

The floor boards 200 are attached only to the nailing beds 30 and are not attached to the springs 40. To prevent the occurrence of a large gap between the side walls and the floor boards 200 due to the presence of the springs 40, a section of a sleeper, designated by the numeral 2, is placed along side the spring end of each sleeper 1 nearest the side wall. The sleeper section 2 is identical to the sleeper 1 except that there is no spring 40, stop 50, fastening element 52 and scale 80. Thus, the nailing bed 30 extends the full length of the guideway 10 of the sleeper section 2. The additional sleeper section 2 serves as a support so that the floor boards can be supported up to a conventional distance of about 2 inches from the side walls.

The operation of the second embodiment is similar to the operation of the first embodiment with respect to the interaction of the guideway 10, nailing bed 30 and resilient strip 20. The interaction of these elements will therefore not be described in detail. As FIG. 4 schematically illustrates, all of the springs 40 of the sleepers 1 are positioned to bias the floor boards 200 toward the center line. As in the first embodiment, the nailing beds 30 are free to slide along the guideways 10 and are confined within the guideway 10 by engagement of the shoulders 32, 34 with the tabs 15, 16. However, in the second embodiment, the springs 40 maintain a biasing force which helps to restore and maintain the floor boards 200 in their nominal position during dimensional changes in the floor boards 200 arising from varying moisture content and the like.

Figure 5B:
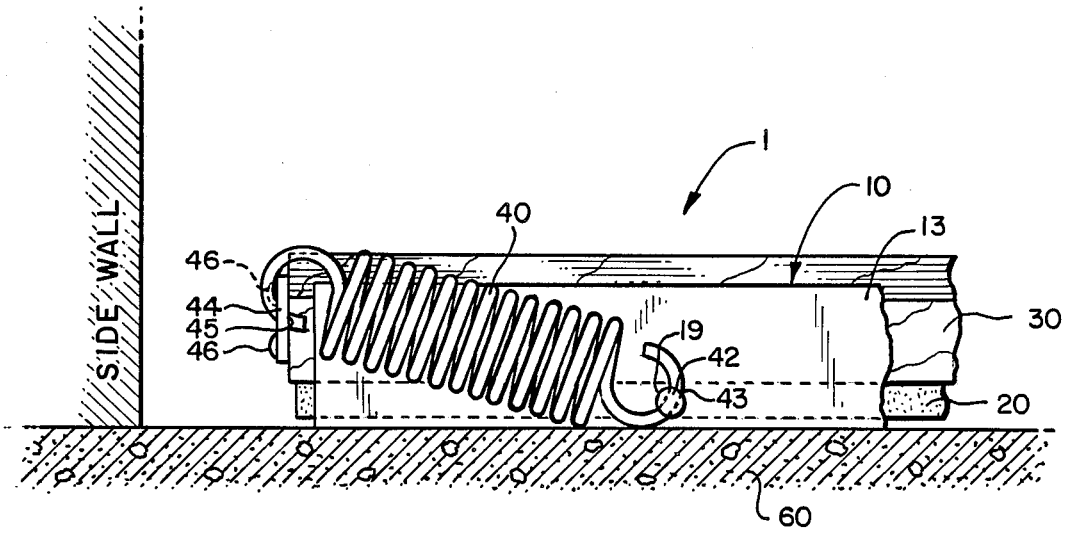
FIG. 5*b* is a side elevational view of the embodiment shown in FIG. 5*a*.

A third preferred embodiment is shown in FIGS. 5*a* and 5*b* and generally represented by the reference numeral 1. The third embodiment is identical in structure and function to the second embodiment except for the means for biasing the nailing beds 30. Structure similar in shape and function to that of the first preferred embodiment will be designated by like reference numerals.

In the third embodiment, two coil springs 40 are positioned outside the guideway 10. This allows the nailing beds 30 to extend the full length of the guideway 10 to support the floor boards 200. The springs 40 are fastened to a nailing bed 30 at one or both ends of the guideway 10 by means of an attachment bar 44. The attachment bar 44 is mounted to the end of the nailing bed 30 so as to extend transversely to the longitudinal axis defined by the nailing bed. The mounting is done using conventional fastening elements 46. Each end of the attachment bar 44 comprises an aperture 45. An end of each spring 40 passes through a respective aperture 45. The other end of each spring 40 is attached to the guideway 10 by means of an attachment rod 42. The attachment rod 42 is passed through apertures 19 located in the sides of the guideway 10. Resilient foam strips 22 support the nailing bed 30 above the attachment rod 42. Each end of the attachment rod 42 comprises an aperture 43. The remaining end of each spring 40 is passed through the respective aperture 43.

The installation of the third embodiment is similar to that of the second embodiment and will therefore not be described in detail. One advantage of the third embodiment is that since the sleeper 1 can support the floor boards 200 over the entire length, supporting sections of sleepers 2, described above, are not needed. It may of course still be advisable to overlap the sleepers 1 in the lineal configurations described in reference to the second embodiment to allow the nailing beds 30 adequate room to slide within the guideway 10.

By way of illustration and with no limitation intended, the following is given to further define the preferred embodiments. In the first, second and third embodiments, each guideway 10 of the sleepers 1 is formed from 18 gauge steel, measures 2½ inches by 1⅝ inches in cross-section and 12 feet, 6 inches in length. The guideway 10 of the sleeper sections 2 are similarly dimensioned except that the length is reduced to approximately 12 inches. During installation, the guideways 10 are spaced 12 inches on center and shimmed and anchored every 36 inches. The anchoring means are conventional anchors measuring 1½ inches and extend into the concrete floor base 60 a minimum of 1 inch.

The resilient strips 20 are formed from cross-linked polyethelyne foam of 2 pounds per square inch density. Each strip 20 has cross-sectional dimensions of ½ inches by 2 inches. The strips 20 are installed the full length of the nailing beds 30.

Each nailing bed 30 measures approximately 2¼ inches wide, 1 5/16 inches thick and approximately 4 feet long with the exception of the nailing beds 30 used in the sleeper sections 2 which are 12 inches in length. The nailing beds 30 are beveled at a 15 degree angle such that at ⅞ inches from the bottom the nailing bed 30 measures 1 7/16 inches. The width of the protrusion 36 measures approximately 9/16 inches. Each nailing bed 30 is formed from Ponderosa Pine or spruce and is Wolmanized treated to reduce moisture absorption. In the third embodiment, the nailing beds 30 are, when combined, sufficiently long to extend the full length of the guideway 10.

Each coil spring 40 used in the second embodiment measures 5 inches long and 1.687 inches in diameter. Each spring 40 can be compressed 2.644 inches with a compression strength of approximately 59.8 pounds per inch. Each coil spring 40 used in the third embodiment measures 4 inches long and 1.250 inches in diameter. Each spring 40 can be extended 2.30 inches with an extension strength of approximately 27.2 pounds per inch.

The attachment bar 44 is ⅛ inches in thickness, 5 inches long and 1 inch wide. The attachment bar 44 is formed of hardened steel. The attachment rod 42 is ⅜ inches in diameter and 5 inches long. The attachment rod is formed of hardened steel.

Of course, it should be understood that a wide range of changes and modifications can be made to the preferred embodiments described above. For example, materials and dimensions of materials, other than those recited, can be used for various applications. Further, the invention may be used with a variety of flooring materials and floor base materials, as well as with conventional water proofing and vapor barriers. It may be desirable to alter the order or manner of installation to suit the particular application or surrounding circumstances. Also, the invention is not limited to the attachment of flooring material. The invention may be used to attach any appropriate covering material to an appropriate surface. It is therefore intended that the foregoing detailed description be regarded as illustrative rather than limiting, and that it be understood that it is the following claims, including all equivalents, which are intended to define the scope of this invention.

We claim:

1. A sleeper of the type used in attaching covering material to a surface, the sleeper comprising:

an attachment member adapted for attachment to the covering material;

means for biasing the attachment member away from the surface; and means for mounting the attachment member to the surface such that the attachment member is slidable along at least one guided direction relative to the surface and the means for biasing is not tightly engaged by the means for mounting.

2. The invention of claim 1 wherein the means for mounting comprises an elongated guide channel adapted to allow attachment of the covering material to the attachment member and wherein the mounting means further comprises means for retaining the attachment member substantially within the guide channel.

3. The invention of claim 1 wherein the means for mounting comprises an elongated guide channel of C-shaped cross section defining an elongated partially open face, the guide channel mounted to the surface such that the partially open face runs substantially parallel to the surface and faces away from the surface.

4. The invention of claim 1 wherein the means for mounting the attachment member confines the attachment member within a predetermined distance away from the surface.

5. The invention of claim 3 wherein the attachment member is of T-shaped cross-section defining a base portion and a cross portion, the nailing bed positioned within the guide channel such that the base protrudes through the partially open face of the guide channel for attachment to the covering material.

6. The invention of claim 5 wherein the protruding base portion is beveled.

7. The invention of claim 5 wherein the attachment member comprises wooden material.

8. The invention of claim 1 wherein the means for biasing the attachment member comprises a strip of resilient material.

9. The invention of claim 1 wherein the means for biasing the attachment member comprises cross-linked polyethelyne foam.

10. The invention of claim 1 wherein the means for biasing the attachment member is positioned between the nailing bed and the surface.

11. The invention of claim 1 wherein the system further comprises means for biasing the attachment member along the at least one guided direction.

12. The invention of claim 11 wherein the means for biasing the attachment member along at least one guided direction comprises a coil spring.

13. The invention of claim 11 wherein the means for biasing the attachment member along the at least one guided direction comprises two coil springs positioned on respective sides of the guide channel.

14. A sleeper of the type used in attaching flooring to a floor base, the sleeper comprising:

an elongated guide channel comprising an elongated partially open face, the partially open face being partially closed by at least one tab extending into the open face area from at least one side of the open face area;

a resilient layer of material positioned in the bottom of the guide channel;

a nailing bed adapted to fit substantially within the guide channel and supported by the resilient layer, the nailing bed further adapted to engage the elongated tab to vertically confine the nailing bed substantially within the guide channel, the nailing bed slidable in at least one direction within the guide channel;

a stop member positioned at at least one end of the elongated guide channel; and a coil spring disposed between the stop member and the nailing bed to bias the nailing bed along the guide channel.

15. A method of installing flooring material on a floor base, the method comprising the following steps:

fastening a guideway defining a guide channel to the floor base;

positioning a fastening member within the guide channel such that the fastening member is slidable along at least one direction guided by the guideway;

fastening flooring material to the fastening member; and biasing the fastening member along the at least one direction within the guideway.

16. A method of installing flooring strips in a room with a floor base; the floor base defining a center line and a vertical direction; the flooring strips defining a longitudinal axis and installed such that the longitudinal axis of each flooring strip is substantially parallel to the center line; the method comprising the following steps:

positioning a plurality of elongated guide channels, each guide channel of C-shaped cross-section with an elongated partially open face facing upwardly; the guide channels oriented in a direction perpendicular to the center line to form a series of spaced, substantially parallel, lineal configurations; each guide channel in each lineal configuration overlapping the end of the adjacent guide channel in the configuration;

positioning an elongated strip of resilient material in at least selected guide channels;

positioning an elongated flooring fastening member within each guide channel; the fastening member and guide channel cooperating such that the fastening member is confined by the guide channel to a predetermined vertical space and slidable along the longitudinal axis of the guide channel; the resilient material cooperating with the fastening member to bias the fastening member in the vertical direction;

securing selected ones of the flooring strips to the fastening members, and biasing selected fastening members along the guide channel towards the center line by means for biasing permanently positioned at at least one end of the guide channel before the end of the guide channel is covered by the flooring strips.

17. The invention of claim 16 wherein the step of securing selected ones of the flooring strips to the fastening members is performed from the center axis region outwardly.

18. The invention of claim 16 wherein the means for biasing comprises a biasing element disposed within the guided channel.

19. The invention of claim 16 wherein the means for biasing comprises at least one biasing element disposed along the outer side of the guide channel.

20. An attachment system for attaching covering material to a substantially flat surface, the attachment system comprising:

a nailing bed comprising at least one elongated segment and adapted for attachment to the covering material;

a guide unit for confining the nailing bed within a predetermined distance from the surface, the guide unit operative to allow the nailing bed to slide along at least one guided direction parallel to the surface;

means for fixedly attaching the guide unit to the surface at a predetermined orientation relative to the surface; and a plurality of resilient pads for biasing the nailing bed in a direction substantially away from the surface, the resilient pads interposed at spaced intervals along the guide direction between the nailing bed and the guide unit such that each resilient pad is not tightly engaged by the guide unit.

* * * * *

UNITED STATES PATENT AND TRADEMARK OFFICE

CERTIFICATE OF CORRECTION

PATENT NO. : 4,856,250

DATED : August 15, 1989

INVENTOR(S) : Arthur W. Gronau et al.

It is certified that error appears in the above-identified patent and that said Letters Patent is hereby corrected as shown below:

IN THE FOREIGN PATENT DOCUMENTS

Title page, item [56], column 2, on the lines following "53863 6/1980 Denmark", please insert --240178 4/1946 Switzerland
2,572,446 5/1986 France
50695 9/1935 Denmark--

In claim 5, column 8, line 28, please delete "nailing bed" and substitute therefor --attachment member--.

Signed and Sealed this

Twenty-fifth Day of August, 1992

*Attest:*

*Attesting Officer*

DOUGLAS B. COMER

*Acting Commissioner of Patents and Trademarks*